US007174709B1

(12) United States Patent
Trager

(10) Patent No.: US 7,174,709 B1
(45) Date of Patent: Feb. 13, 2007

(54) TURBOSCREEN ASSEMBLY FOR DIESEL EXHAUST SYSTEMS

(75) Inventor: John Trager, Bella Vista, AR (US)

(73) Assignee: The Board of Trustees of the University of Arkansas, Little Rock, AR (US)

( * ) Notice: Subject to any disclaimer, the term of this patent is extended or adjusted under 35 U.S.C. 154(b) by 0 days.

(21) Appl. No.: 10/851,461

(22) Filed: May 21, 2004

Related U.S. Application Data

(60) Provisional application No. 60/472,154, filed on May 21, 2003.

(51) Int. Cl.
*F01N 3/02* (2006.01)

(52) U.S. Cl. ..... 60/311; 60/280; 60/282; 60/323; 415/121.2; 415/121.3

(58) Field of Classification Search ..... 60/272, 60/280, 282, 311, 322, 323, 324; 415/121.2, 415/121.3
See application file for complete search history.

(56) References Cited

U.S. PATENT DOCUMENTS 3,286,459 A * 11/1966 Ephraim, Jr. ..... 60/614
3,352,104 A * 11/1967 Duerr ..... 60/614
3,735,587 A * 5/1973 Addie et al. ..... 60/624
4,076,508 A 2/1978 Christensen
4,077,739 A * 3/1978 Heilenbach ..... 415/121.2
4,405,449 A 9/1983 Trager
4,788,819 A 12/1988 Henkel
4,821,520 A * 4/1989 Rumfield ..... 60/614
5,298,046 A 3/1994 Peisert
5,404,716 A * 4/1995 Wells et al. ..... 60/272

* cited by examiner

*Primary Examiner*—Binh Q. Tran
(74) *Attorney, Agent, or Firm*—Medicus Associates; James H. Meadows

(57) ABSTRACT

A turboscreen for use with diesel exhaust systems comprises a plurality of parallel metal V-shaped wires joined with a peripheral band. The turboscreen is reversibly provided within a housing assembly that permits removal of the interior screen without detaching the housing assembly from the exhaust system. The interior screen can be removed from the housing by removing and/or loosening bolts that connect the plates of the housing and withdrawing the screen. Maintenance times and repair costs are thereby reduced.

13 Claims, 3 Drawing Sheets

TURBOSCREEN ASSEMBLY FOR DIESEL EXHAUST SYSTEMS

REFERENCE TO RELATED APPLICATION

This application claims the benefit of U.S. Provisional Application No. 60/472,154, filed May 21, 2003, the disclosure of which is incorporated herein by reference.

FIELD OF THE INVENTION

The present invention relates to diesel engine exhaust systems, and particularly relates to the exhaust systems of diesel locomotives.

BACKGROUND OF THE INVENTION

Current diesel engines operate at high temperatures under tight part tolerances that can present demanding thermal and mechanical conditions to the parts of the engine. For instance, large, smoldering soot particles can be ejected in the exhaust from the engines, which risk starting fires in forests, grasslands, etc. The thermal expansions associated with normal heating and cooling cycles of the engine cause gaps to appear between and among the various parts of the engine, such as the junction points between the exhaust manifold and the engine. This results in bypass of hot gases from the exhaust stream, thereby reducing engine efficiency, due to reduced turbo recovery efficiency, and increasing pollution, especially when a catalytic converter is employed. Moreover, the harsh mechanical conditions encountered in the diesel engines occasionally cause the breakage of parts, valve stems, keepers, and the like, which are ejected from the engine and into the exhaust system. If the parts are not captured, e.g., by a screen or parts catcher placed in the path of the exhaust gases, significant damage to the turbocharger can occur.

Conventionally, a diesel "turboscreen" consists of a metal plate provided with a plurality of perforations. The perforations can clog with soot, thereby increasing backpressure and reducing fuel efficiency. An example of a "debris separator" proposed for use in removing debris from the hot gas stream of engine exhaust is that of U.S. Pat. No. 4,076,508 (issued to Christensen). This system is primarily concerned with removing smaller debris that can pass through the perforations of conventional screens.

Specifically, a centrifugal separation system is proposed for swirling the hot gases radially outward into a chamber from which the gases then pass through a cylindrical screen. The debris is collected in a lower chamber and periodically removed from the assembly via an access port. In this system, the cylindrical screen is welded at one end "in cantilever fashion" to a flange, which is attached to the turbocharger inlet. Apparently, it is necessary to remove the entire housing in order to clean or replace the screen whenever it becomes plugged with soot.

Other approaches to cleaning the exhaust stream of diesel engines are focused on removing soot. For instance, U.S. Pat. No. 4,788,819 (issued to Henkel) employs an electrically charged cylindrical filter element that contains a loose material. The combination of loose material and electrical charge reportedly are effective in removing soot. However, this device is unconcerned with catching larger particles or parts and would likely entail significant maintenance requirements. Another particulate filter element is proposed by U.S. Pat. No. 5,298,046 (issued to Peisert). The filter element comprises a woven or nonwoven wire screen in the form of a spiral roll.

One object of the present invention is to reduce the time and labor associated with cleaning or replacing the debris screen provided between a diesel exhaust manifold and turbocharger. Another object of the present invention is to reduce the time and cost associated with maintenance of the exhaust manifold, generally.

SUMMARY OF THE INVENTION

The present invention is for a screen and accompanying holding assembly that can be used to catch debris expelled from the exhaust of a diesel engine before the debris passes into a downstream turbocharger. The screen, often referred to herein as a "turboscreen," comprises a plurality of uniformly spaced, parallel metal wires, each having a V-shaped profile. The wires are linked together by an encircling metal band irreversibly joined, e.g., welded, to the ends of each wire. The wires are also preferably crosslinked to adjacent wires and to the metal band by perpendicular cross-members (bars), which provide additional support. A preferred turboscreen is flat and circular in shape.

The present invention is also for a turboscreen assembly that comprises a screen holding means, and a metal screen provided interior the holding means. The screen holding means preferably comprises two opposing annular flange members that clamp the periphery of a turboscreen provided therebetween. The screen holding means permits attachment of the assembly to the adjoining manifold and turbocharger, such as with the use of bolts that extend through securing tabs on the flanges and collars placed around both the manifold and turbocharger housings. Withdrawal of the turboscreen is effected by removing some of the bolts and loosening others, which permits removal of the interior screen and attached flange members.

BRIEF DESCRIPTION OF THE DRAWINGS

FIG. 1 illustrates different aspects of an exemplary turboscreen and assembly of the invention.

FIG. 2 illustrates another embodiment of the present invention in which the turboscreen comprises a plurality of uniformly spaced, parallel V-shaped wires attached to a plurality of support bars.

FIG. 3 depicts a cross-sectional view of the proximal end of a single exhaust system as implemented with a turboscreen of the present invention.

DETAILED DESCRIPTION OF THE INVENTION

The present invention is for a novel exhaust management assembly for use with diesel engines, especially those that employ a turbocharger to recover energy from the hot exhaust gases. A particularly suitable application is with diesel locomotive engines. Other applications contemplated include river barges, offshore oil rigs, mining scoops, and standby generators. The present invention aims to significantly reduce the costs associated with maintenance and operation of diesel engines, particularly due to the buildup of tar deposits and structural damage to the screen.

Figure 1C:
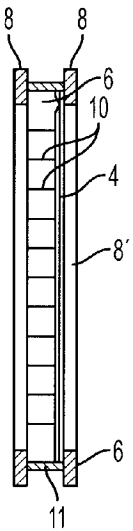
FIG. 1C shows a cross-sectional side view of the screen and housing.
Figure 1B:
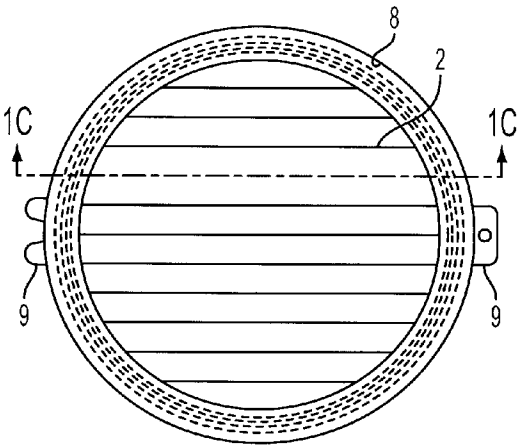
FIG. 1B shows a turboscreen assembly that comprises the screen of FIG. 1A and dual opposing flanges.
Figure 1A:
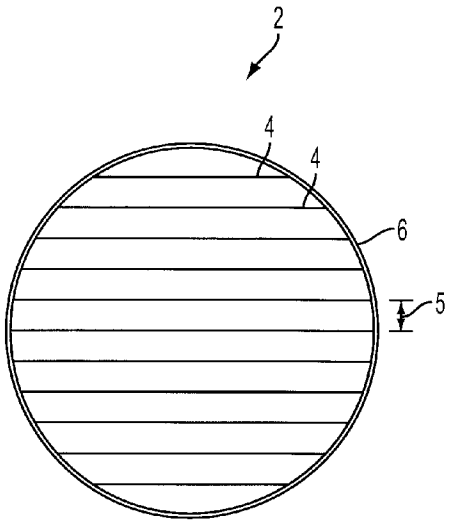
FIG. 1A shows the turboscreen including parallel wires and encircling band.

As shown in FIG. 1A, in one embodiment of the invention, turboscreen 2 comprises a plurality of uniformly-spaced parallel wires 4 joined at their ends by circular metal band 6. In the figure, the wires are represented as having a uniform thickness, although this is not typically the case. Preferably, the spacing 5 between adjacent wires is in the range 0.090 to 0.150 inch. More preferably, the gap between adjacent wires is less than about ⅛ inch in order to ensure effective blockage of ejected parts, such as valve pieces. The turboscreen shown in FIG. 1A can be employed with a smaller engine and, as depicted in the figure, is provided without crosslinking support bars.

FIG. 1B shows a perspective view of turboscreen 2 pressed between two parallel annular plates (flanges) 8, which secure the screen therebetween and permit anchoring it to an external assembly, such as between the exhaust manifold and turbocharger (not shown). To this end, one or both of flanges 8 can be provided with a groove to accept a protruding gasket from either or both the turbocharger and the manifold, thereby reducing leakage of hot gases from the exhaust system. Securing means 9 illustrate how the screen/flange assembly can be secured to the manifold and the turbocharger.

FIG. 1C shows a cross-sectional view of the assembly depicted in FIG. 1B taken along view line C—C. Thus, metal wire 4 appears as a vertical line on the right-hand side in the figure. Band 6 is shown at both top and bottom regions of the screen. Wire 4 is welded to support bars 10 (which are not shown in FIGS. 1A and 1B). Annular flanges 8 are shown as being contiguous by virtue of a bar spacer 11 between them and the flanges are held together by a plurality of bolts (not shown). A phantom section of the flange 8' is indicated and is visible from an end-on view. Optionally, a skirt (not shown) can be attached to the outer band of the screen if it is desired to space the screen from the flange.

Figure 2A:
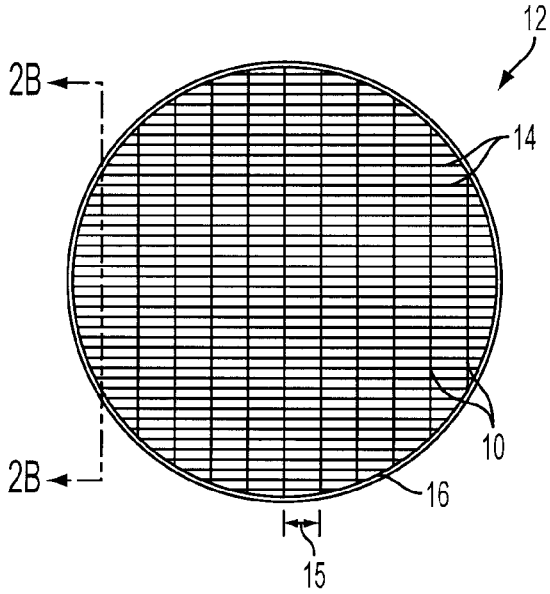
FIG. 2A shows the overall turboscreen and FIG. 2B shows the V-shaped profiles of the wires joined to a crosslinking support bar.

FIG. 2A shows another embodiment of the present invention, which is appropriate for larger diesel engines, such as EMD locomotive engines. Thus, turboscreen 12 comprises a plurality of uniformly-spaced and parallel V-shaped wires 14 joined at their ends by circular metal band 16. The wires are preferably tapered in order to reduce aerodynamic drag in the exhaust gas stream and are welded at their flat edges, opposite the pointed side, to a plurality of support bars 10. As before, the spacing between adjacent wires is selected to ensure catching broken valve parts, and the like, without increasing exhaust backpressure too much. Support bars 10 are preferably some four times thicker than the wires in order to provide adequate bracing and support. The spacing 15 between adjacent support bars is selected to provide adequate support for the wires without adding unnecessary weight and is preferably in the range of 1 to 2 inches, more preferably, about 1.625 inches.

The pressure drop for exhaust gases passing through a turboscreen of the present invention can be less than about 60% of that for conventional perforated plates. In fact, the pressure drop can be optimized by setting the spacing between parallel wires, which changes the resistance factor of gases passing through the screen. Additionally, under the exhaust temperatures of the engine, which are in the range 950–1000 F, considerable stresses are placed on the screen components. A turboscreen of the present invention can have a physical strength at operating temperatures that is some 20–30 times that for a conventional screen. The turboscreen is sized to fit within a housing itself sized appropriately for an exhaust system. For a diesel locomotive exhaust system, the overall size for the turboscreen is preferably about fifteen inches in diameter. Other exhaust systems can employ larger or smaller turboscreens, as is readily apparent.

Figure 2B:
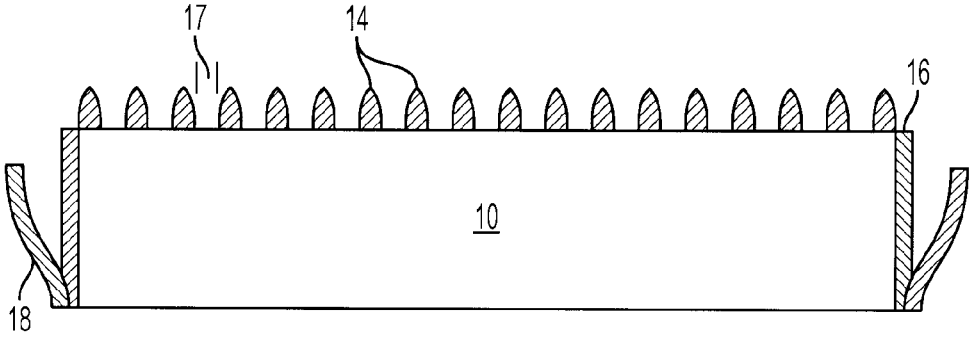

FIG. 2B shows a cross-section of the turboscreen in FIG. 2A taken along view line B—B. The V-shaped profiles of wires 14 are evident in the drawing. The wires are attached to support bar 10 with a desired separation between the wires. Preferably, the gap between wires is in the range 0.090 to 0.150 inch, more preferably about 0.10 inch. The base widths of the wires typically fall into a range of 0.10 to 0.25 inch, with the selection of available wire widths being determined by the preferred manufacturer, of which there are many. Also depicted in FIG. 2B is skirt 18 attached to band 16.

Figure 3A:
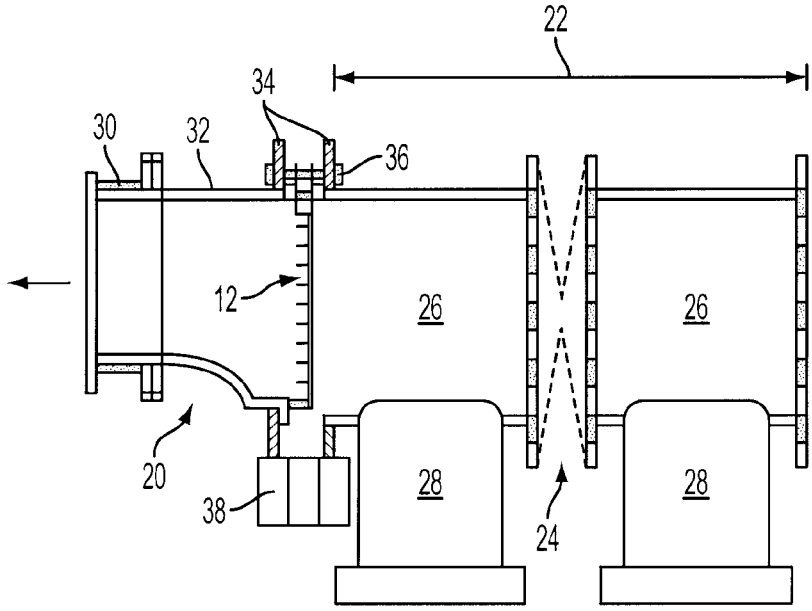
FIG. 3A shows bellows, optionally, provided between adjacent receiving chambers of the exhaust manifold.

A cross-section of a single diesel exhaust system region proximal to the turboscreen housing is illustrated in FIG. 3A. Thus, turboscreen assembly 20 is positioned adjacent the exhaust manifold region 22. As shown, the exhaust manifold is segmented with 14-inch width bellows 24 joining individual receiving chambers 26 of the manifold, which receive hot exhaust gases from the engine through "legs" 28. Conventionally, the bellows are provided only between each pair of receiving chambers. Therefore, the device depicted in FIG. 3A represents a novel addition to the assembly, which may be desired in order to reduce temperature stresses and improve efficiency. Turboscreen 12 is interposed between the exhaust manifold and the turbocharger (not shown). Conventionally, a bellows 30 joins the turbocharger to turboscreen housing 32. Collars 34 press against lips on the turboscreen housing and the manifold, thereby joining the two. Bolt 36 is shown passing through tabs on the flanges of the turboscreen, which holds the screen in position. Any parts caught by the screen can drop into bin 38 and be removed by a door therein.

Figure 3B:
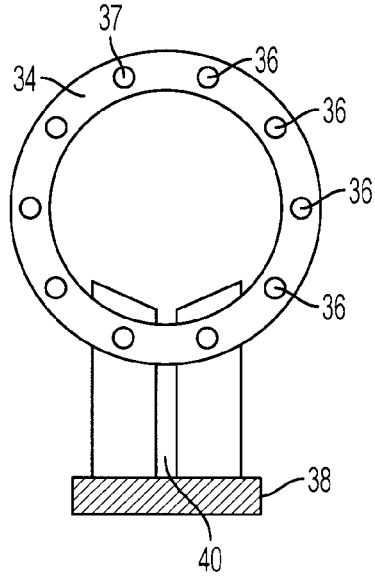
FIG. 3B shows an end-on view of a collar assembly for attaching the turboscreen assembly to the adjoining manifold and turbocharger, with indications made as to which bolts to remove and which to loosen.

A turboscreen housing of the present invention permits ready access to and removal of an internal screen means that is positioned between the exhaust manifold and the turbocharger. As shown in cross-section in FIG. 3B, the turboscreen housing comprises jackscrew flange (collar) 34, which supports a flat metal turboscreen interior the housing. The housing can be opened and the screen removed by removing bolts 36 along the side of the flange proximate the worker, and loosening the other bolts, exemplified by bolt 37, as needed. Also shown in the figure is the parts collection area 40 in bin 38. Currently, workers must completely detach and remove the collector section from the exhaust system in order to clean or replace it. With the present invention, the screen can be accessed and replaced by a single worker without having to perform the laborious task of removing the collector section.

In a distinct aspect of the invention, bellows means are provided between each receiving chamber 26 of the exhaust system. Provision of such bellows means permits thermal expansion of the respective chambers to occur independently without loosening their attachments to the engine. A temperature gradient exists between the receiving chambers (900F) and the engine block (120F). Due to spacing considerations between adjacent legs 28, two different widths of bellows are contemplated: those corresponding to prior art placements are greater in width (14 inches) than those between other adjacent legs (8–12 inches). This aspect of the invention is expected to better prevent leakage of polluting gases from the engine manifold and permit a reduced frequency of maintenance for tightening the attachments.

To manufacture a turboscreen of the present invention, first, profiled wire circles can be stamped out of a rectangular wire grid. Many wire manufacturers provide wires suitable for the screen. A preferred screen supplying sufficient strength is a wedge-wire screen available from Tate Andale Canada, Inc. (Ontario, Canada). Preferred wires have a profile width ranging from 0.116 to 0.158 inch and a profile height ranging from 0.185 to 0.239 inch. The profiled wires are installed in a jig fixture with points facing down, separated by the desired gaps, e.g., 0.10 inch. The support bars are then attached vertically to the tops of the wires, with a separation between adjacent support bars of about 1.625 inch. This assembly is clamped in place and a double-headed TIG welder is run along the support bars thereby welding the bars to the profiled wires. Similarly, a banding strip is then attached by welding along the periphery of the wire grid to hold the wires in place. Finally, an outer skirt can be attached to the outer band by welding along the outer circumference of the banding strip.

The present invention has been described hereinabove with reference to particular examples for purposes of clarity and understanding. However, it should be appreciated that certain improvements, equivalents, and modifications of the invention can be practiced within the scope of the appended claims.

What is claimed is:

1. In a diesel exhaust system comprising:

an exhaust manifold capable of receiving hot exhaust gases exiting from a diesel engine, said exhaust manifold having multiple receiving chambers;

a turbocharger capable of recovering energy from said hot gases; and a screen assembly provided between the exhaust manifold and the turbocharger, which screen assembly is capable of preventing metal parts exiting from the exhaust manifold from passing into the turbocharger, the improvement comprising said screen assembly comprising a metal screen reversibly immobilized interior a screen holding means, which holding means permits external loosening of a flange member and removal of the interior screen without detaching the screen holding means from the screen assembly, wherein the metal screen comprises a plurality of uniformly spaced, parallel wires each having a V-shaped profile, said wires being linked together by a metal band irreversibly joined to the ends of each wire.

2. The exhaust system of claim 1, further comprising a plurality of bellow means, wherein a bellow means is provided between each of adjacent said receiving chambers, thereby permitting thermal expansion of each receiving chamber independent of an adjacent chamber.

3. The exhaust system of claim 1, wherein a bellow means is provided between the screen assembly and the chamber most proximate thereto.

4. The exhaust system of claim 1, wherein the wires are further joined to adjacent wires by a plurality of parallel crosslinks.

5. The exhaust system of claim 1, wherein the screen has a flat or cylindrical shape.

6. The exhaust system of claim 1, which is used with a diesel locomotive engine.

7. An exhaust gas screen assembly comprising:

a screen holding means having opposing flange members;

a screen provided interior the screen holding means and between the flange members, wherein the screen comprises a plurality of uniformly spaced, parallel metal wires, each having a V-shaped profile, said wires being linked together by a metal band irreversibly joined to the ends of each wire; and a plurality of flange joining means that enable clamping the interior screen between the opposing flange members, wherein loosening or removal of at least one of the flange joining means affords sufficient separation and detachment of the flange members to permit removal of the screen interior the screen holding means without completely detaching the flange members from each other.

8. The exhaust gas screen assembly of claim 7, wherein the opposing flange members are parallel annular plates.

9. The exhaust gas screen assembly of claim 7, wherein the flange joining means comprises bolts.

10. The exhaust gas screen assembly of claim 7, wherein the wires are welded to the metal band.

11. The exhaust gas screen assembly of claim 7, wherein the wires are further joined to adjacent wires by a plurality of parallel crosslinks.

12. The exhaust gas screen assembly of claim 7, which is circular or semi-cylindrical in shape.

13. The exhaust gas screen assembly of claim 7, wherein adjacent wires are separated by less than about ⅛ inch.

* * * * *